United States Patent [19]

Dorsch et al.

[11] Patent Number: 4,466,421

[45] Date of Patent: Aug. 21, 1984

[54] AFTERBURNER FOR A WOOD STOVE

[75] Inventors: Eddy H. Dorsch, Woodlands, Canada; Herbert Dorsch, General Delivery, Woodlands, Manitoba, Canada, R0C 3H0

[73] Assignee: Herbert Dorsch, Woodlands, Canada

[21] Appl. No.: 554,233

[22] Filed: Nov. 22, 1983

[51] Int. Cl.[3] ..... F23L 3/00; F23J 15/00; A01D 75/06; F23Q 11/00; F01C 1/00

[52] U.S. Cl. ..... 126/285 A; 126/292; 110/203; 55/422; 431/268; 422/177

[58] Field of Search ..... 126/108, 16, 285 A, 126/292, 307 R, 289, 296, 285 R; 110/119, 203, 210, 211; 122/4 D; 55/307, 422, DIG. 30, DIG. 20, 445; 431/268; 422/180, 181, 176, 177, 171

[56] References Cited

U.S. PATENT DOCUMENTS

| | | | |
|---|---|---|---|
| 3,823,532 | 7/1974 | Cooper | 55/422 |
| 4,279,629 | 7/1981 | Simms | 55/422 |
| 4,319,556 | 3/1982 | Schwartz | 126/289 |
| 4,373,507 | 2/1983 | Schwartz | 126/285 A |
| 4,409,185 | 10/1983 | Krause | 422/177 |

FOREIGN PATENT DOCUMENTS

| | | | |
|---|---|---|---|
| 2081887 | 2/1982 | United Kingdom | 110/210 |

*Primary Examiner*—Samuel Scott
*Assistant Examiner*—G. Anderson
*Attorney, Agent, or Firm*—Stanley G. Ade

[57] ABSTRACT

An afterburner for a wood stove for use as a retrofit assembly comprises a rectangular housing having openings in the upper and lower surfaces provided with cylindrical collars for cooperation with the flue duct and with the opening in the top of the wood stove respectively. The openings are positioned at the rear of the housing so as to provide a forward section spaced from the openings. A catalytic combuster mounted in a cylindrical support is movable from a position directly above the opening in the bottom surface into the front section by a manually operable handle extending through the front face of the housing. A baffle mounted on the support and arranged at a shallow angle to the horizontal overlies the major part of the combuster so as to direct gases into the front section of the housing for heat exchange contact with the walls thereof.

14 Claims, 5 Drawing Figures

AFTERBURNER FOR A WOOD STOVE

BACKGROUND OF THE INVENTION

This invention relates to an afterburner for a wood stove and particularly to an afterburner which can comprise a retrofit assembly for attachment to existing wood stoves in position between the flue outlet of the wood stove and the conventional flue of the wood stove.

Catalytic combusters or afterburners have become available recently for use with wood stoves to burn the gases issuing from the burning wood which gases normally escape from the wood stove in the flue. This has a number of advantages. Firstly the burning of the combustible gases can be used to provide additional heat thus substantially increasing the efficiency of combustion of the wood fuel. Secondly and in some areas more importantly, the burning of the combustible gases very much reduces the amount of pollution issued from the wood stove thus allowing the wood stove to be used in areas where otherwise only smokeless fuel is allowed to be burned.

Designs have been developed for using the combusters in wood stoves and one particular problem which must be taken into account is that the combuster only operates when the gases reach a particular temperature and therefore at start up of the combustion it is necessary to remove the combuster from the flue gases and return it to the flue gases when they reach the desired temperature. Various arrangements have been proposed for varying the path of the flue gases so that at start up they are diverted from the combuster. Normally this is done using a damper which opens a first path remote from the combuster to allow the flue gases to escape directly to the flue while closing the combuster and vice versa when the gases have reached the required temperature closing the diverting path and opening the path through the combuster.

None of the designs proposed has been entirely satisfactory and certainly no design has been proposed which is particularly suitable as a retrofit assembly to enable the afterburner to be sold separately from the wood stove for application to existing wood stoves already in the field.

SUMMARY OF THE INVENTION

It is one object of the present invention therefore to provide a design of afterburner which is particularly suitable as a retrofit assembly.

It is a further object of the invention to provide an afterburner which most effectively utilizes the heat developed in the combuster without interfering with the proper flow of flue gases through the flue.

Accordingly the invention provides an afterburner for a wood stove comprising a housing, connection means at the bottom of the housing for connecting the housing to the flue outlet of the wood stove and defining an inlet into the housing for flue gases from the wood stove, connection means at the top of the housing for connecting the housing to a flue and defining an outlet from the housing for flue gases escaping to the flue, the outlet and the inlet being arranged adjacent the rear of the housing and in substantially overlying relationship, the housing having a forward section projecting forward in front of the inlet and outlet, a support member for a catalytic combuster, a manually operable handle extending from the exterior of the housing to the support for moving the support from a position in which the combuster overlies the inlet so that flue gases pass therethrough to a position in which the combuster lies in the forward section and is spaced from the inlet so as to allow the flue gases to pass from the inlet to the outlet without passing through the combuster, and baffle means mounted on the support means and movable therewith and arranged such that in the first position the baffle means diverts flue gases from the inlet into the forward section and in the second position the flue gases pass from the inlet to the outlet without engaging the baffle means.

According to a second aspect the invention provides a wood stove including an afterburner comprising a housing, means at the bottom of the housing for defining an inlet into the housing for flue gases from the wood stove, means at the top of the housing for defining an outlet from the housing for flue gases escaping to a flue, the outlet and the inlet being arranged adjacent the rear of the housing and in substantially overlying relationship, the housing having a forward section projecting forward in front of the inlet and outlet, a support member for a catalytic combuster, a manually operable handle extending from the exterior of the housing to the support for moving the support from a position in which the combuster overlies the inlet so that flue gases pass therethrough to a position in which the combuster lies in the forward section and is spaced from the inlet so as to allow the flue gases to pass from the inlet to the outlet without passing through the combuster, the baffle means mounted on the support means and movable therewith and arranged such that in the first position the baffle means diverts flue gases from the inlet into the forward section and in the second position the flue gases pass from the inlet to the outlet without engaging the baffle means.

It is one advantage of the invention therefore that the housing can sit directly on top of the wood stove and can be fitted to the wood stove very rapidly.

It is a further advantage of the invention that the housing provides the forward section into which gases are directed from the combuster by the baffle so the forward section acts as a heat exchanger for communicating heat to the external environment and extracting as much heat as possible from the burning gases.

It is a further advantage of the invention that the forward section provides an area for receiving the combuster when removed from the path of the flue gases at start up of the combustion.

It is a yet further advantage of the invention that the baffle is mounted upon the support and therefore moves with the support from the operative position where the combuster lies in the path of flue gases from the inlet of the housing to the outlet to a position in which both the baffle and the combuster are removed into the forward section thus leaving the flue gases to pass directly from the inlet to the outlet without contacting either the baffle or the combuster.

With the foregoing in view, and other advantanges as will become apparent to those skilled in the art to which this invention relates as this specification proceeds, the invention is herein described by reference to the accompanying drawings forming a part hereof which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
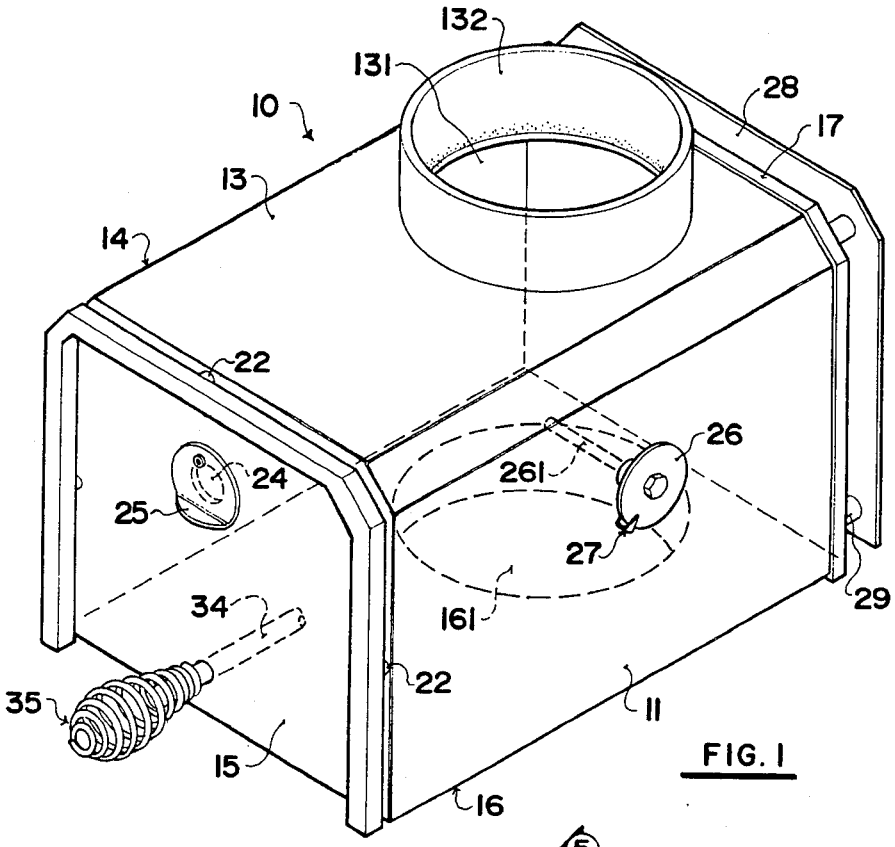
FIG. 1 is an isometric view of the afterburner showing the housing.
Figure 2:
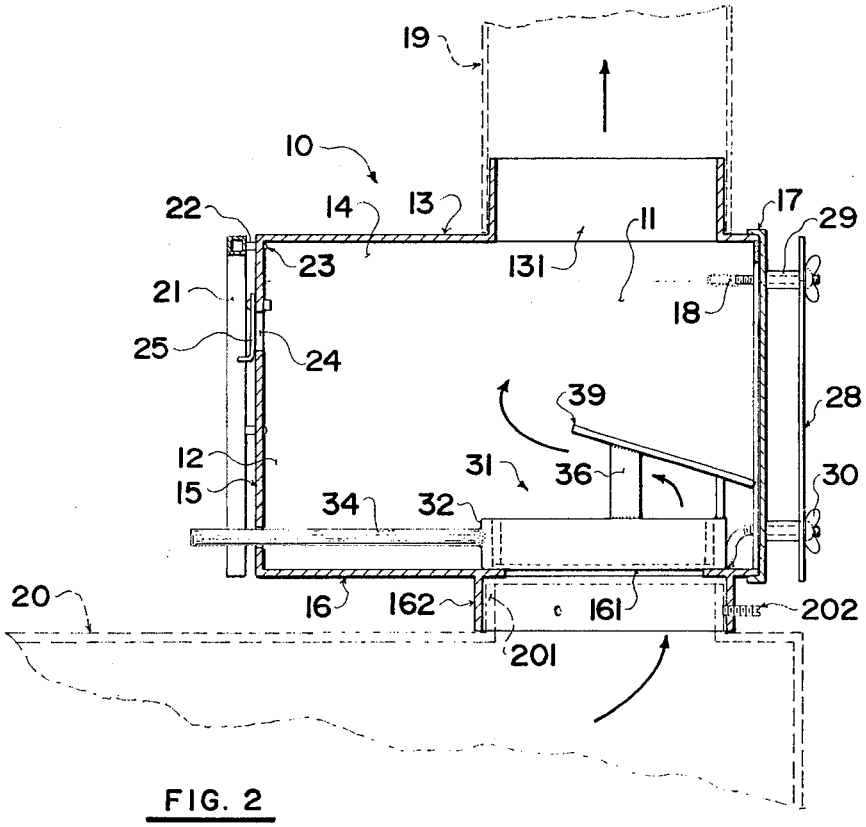
FIG. 2 is a cross sectional view through a longitudinal axis of the housing showing the catalytic combuster in side view.

FIGS. 1 and 2 show the main details of the afterburner apparatus comprising a housing 10 manufactured from formed steel plate so as to provide a substantially rectangular box. The box has sides 11 and 12 and a top 13 formed from a single sheet of steel plate with 45° corner plates 14 avoiding a sharp right angle corner and providing a pleasing appearance. A front plate 15 is welded along the edges of the formed plate and along the edge of a bottom plate 16. A removal rear end cap 17 completes the rectangular box and is attached to the side and base by bolts 18 which are bent so as to pass through openings spaced inwardly of the edge of the rear plate 17.

The upper face 13 has an opening 131 which is circular and provided adjacent the rear of the upper face and has attached around the periphery thereof by welding a collar 132 which extends upwardly in cylindrical form for receiving the flue 19 of a wood stove 20.

Similarly to the uppersurface 13, the lowersurface 16 includes an opening 161 which is coaxial to the opening 131 and of substantially the same dimension so that the opening 131 directly overlies the opening 161. A cylindrical flange 162 is welded to the bottom surface 16 surrounding the opening 161, the dimension of the flange 162 being chosen to match a similar collar 201 provided on the wood stove so that the collar 162 surrounds the collar 201 and is attached thereto by a screw 202 so as to attach the housing 10 directly to the top of the wood stove in a readily removable manner.

A chrome front facing strip 21 is attached around the periphery of the front face 15 by spaces 22 and screws 23 (FIG. 2) so as to provide a pleasing appearance for the front face of the housing and also to provide further metal fins to act as a heat exchanger as will be explained hereinafter.

An opening 24 in the front face is closed by a pivoted cover 24 so that the cover normally hangs over the opening to keep it closed and prevent the escape of smoke from inside the housing. However the cover can be pivoted up manually by a lip 25 to expose the opening for visual observation of the interior of the housing and particularly the combuster described hereinafter.

A thermometer 26 is attached to the side wall 11 of the housing and has a probe 261 extending into the housing for measuring the temperature inside the housing at a position slightly above the combuster. The thermometer has an indicating finger 27 whereby the temperature inside the housing can be readily observed to ensure correct operation of the combuster.

A protective back plate 28 is attached to the bolts 18 and is spaced from the end cap 17 by spacers 29 so as to provide the heat shield to allow the wood stove and associated afterburner to be positioned closer to a wall for other items behind the wood stove than otherwise would be allowable. The plate 28 is held in position by wing nuts 30 which can be readily removed for removal of the plate 28 and the end cap 17 to allow access to the interior of the housing.

A combuster 31 is mounted in a support 32 which is cylindrical for receiving the combuster mounted in a fibrous ring 33 for support. The combuster is of the conventional type which can be purchased for example from Corning Glass Ware and is shown in detail in U.S. Pat. Nos. 4,330,503–4,345,528 and 4,373,452. The catalytic combuster provides a cylindrical body including a honeycomb structure through which the smoke from the wood stove can pass for combustion on the walls of the combuster. This combustion can only take place when the temperature of the gases exceeds a certain temperature and prior to that time the combuster must be removed from the path of the smoke to avoid interfering with the smoke and to avoid the deposition of creosote and other undesirable items on the combuster thus poisoning the catalyst.

In the position of the combuster shown in FIG. 2, the combuster is positioned directly over the opening 161 for passage of smoke through the combuster. It will be noted that the opening 161 is slightly smaller than the opening 131 to provide an annular flange for supporting the support 32 and thus the combuster 31.

The cylindrical support 32 is attached to a handle 34 which projects forwardly from the support through the front wall 15 of the housing to a manually operable handle 35 which is of the conventional spring-type to reduce the communication of heat from the handle 34 to the operator's hand. By pulling the handle away from the front face 15, the support 32 can be slid forwardly away from the opening 161 into a forward section of the housing 10 spaced forwardly of the openings 131, 161. The front section of the housing then is sufficient in size to receive the support 32 so as to remove it completely from the path between the openings 161, 162 whereby smoke issuing from the wood stove can pass directly to the flue 19 without encountering the support 32 or combuster 31.

Figure 5:
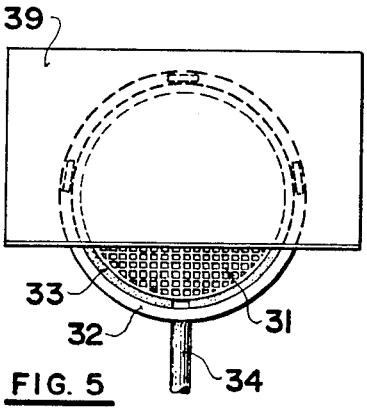
FIG. 5 is a plan view of the catalytic combuster of FIGS. 2, 3 and 4.
Figure 4:
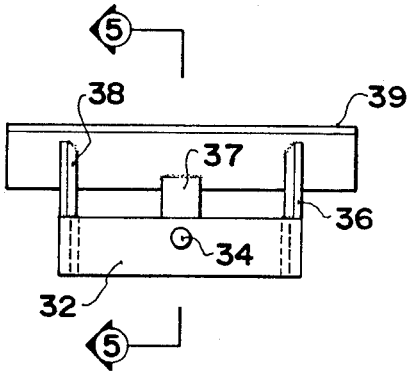
FIG. 4 is a front elevational view of the catalytic combuster of FIGS. 2 and 3.
Figure 3:
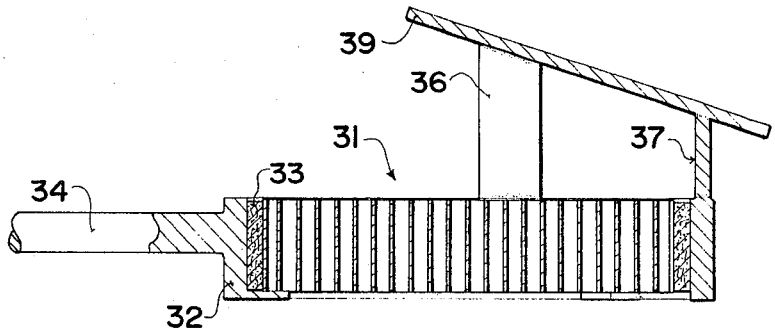
FIG. 3 is a cross sectional view through the catalytic combuster of FIG. 2 on an enlarged scale with the housing and further details omitted.

The cylindrical support 32 includes three upstanding struts 36, 37, 38 which support a baffle 39 in the form of a flat plate at a shallow angle to the horizontal. The plate 39 extends from the rear side of the combuster 31 to a position most of the way across the combuster leaving a small front portion of the combuster exposed as shown in the plan view of FIG. 5. The length of the strut 37 is reduced relative to the struts 36, 38 in order to provide the desired angle of the plate 39. The plate 39 is therefore carried by the cylindrical support 32 and can be moved therewith by the handle 34 into the front section of the housing where it also is removed from the path of the smoke issuing through the opening 161.

In the operative position of the combuster shown in FIG. 2, the baffle plate 39 lies over the combuster 31 in the path of gases issuing from the upper surface of the combuster and thus acts to redirect those gases into the front section of the housing. Thus instead of passing directly from the upper face of the combuster 31 to the opening 131, the gases move into the front section of the housing to encounter the walls of the housing before turning again backwardly toward the opening 131 for movement into the the flue 19 under control of the flue draft. This movement of the gases into the front section causes the walls of the housing to be heated and thus cause the walls to act as a heat exchanger communicating additional heat from the air into the room in which the wood stove is positioned. Thus both the body of the wood stove 20 and the housing 10 act as heat exchangers communicating heat into the room.

At start up of the wood stove 20 or after loading of further fuel, when the temperature of combustion gases leaving the wood stove through the opening 161 is below a predetermined temperature as indicated by the thermometer 26, the handle 34 can be drawn forwardly to remove the baffle 39 and combuster 31 from the path of the flue gases so that the flue draft which is smaller in view of the lower temperature acts to draw the gases upwardly from the opening 161 through the flue 19 without the gases entering the forward section of the housing 10. As soon as the operative observes that the temperature has reached the required temperature as indicated by the thermometer 26 after a time which the experienced operator will soon appreciate, the handle 34 can be pushed rearwardly to position the combuster 31 over the opening 161. As explained previously the baffle 39 then acts to direct the hot gases which are further heated in the combuster 31 forwardly into the front section. It will be noted that the baffle 39 is wider than the support 32 and hence extends substantially completely across the housing 10 so as to direct all gases at the rear of the housing forwardly towards the front of the housing. The sides of the baffle 39 can also be used to slide against the inner surface of the side walls 11 and 12 so as to guide the forward and backward movement of the support 32.

Since various modifications can be made in my invention as hereinabove described, and many apparently widely different embodiments of same made within the spirit and scope of the claims without departing from such spirit and scope, it is intended that all matter contained in the accompanying specifications shall be interpreted as illustrative only and not in a limiting sense.

I claim:

1. An afterburner for a wood stove comprising a housing, connection means at the bottom of the housing for connecting the housing to the flue outlet of the wood stove and defining an inlet into the housing for flue gases from the wood stove, connection means at the top of the housing for connecting the housing to a flue and defining an outlet from the housing for flue gases escaping to the flue, the outlet and the inlet being arranged adjacent the rear of the housing and in substantially overlying relationship, the housing having a forward section projecting forward in front of the inlet, a support member for a catalytic combuster, a manually operable handle extending from the exterior of the housing to the support for moving the support from a position in which the combuster overlies the inlet so that flue gases pass therethrough to a position in which the combuster lies in the forward section and is spaced from the inlet so as to allow the flue gases to pass from the inlet to the outlet without passing through the combuster, and baffle means mounted on the support means and movable therewith and arranged such that the first position the baffle means diverts flue gases from the inlet into the forward section and in the second position the flue gases pass from the inlet to the outlet without engaging the baffle means.

2. The invention of claim 1 wherein the housing is substantially rectangular.

3. The invention according to claim 1 wherein the housing is separate from the wood stove and readily removable therefrom.

4. The invention according to claim 1 wherein the handle projects through the front wall of the housing in the direction of movement of the support.

5. The invention according to claim 1 wherein the forward section is of sufficient dimension to receive the support member and baffle means.

6. The invention according to claim 1 wherein the housing is wider than the inlet and outlet.

7. The invention according to claim 1 wherein the forward section is of the order of the same size as the inlet and outlet.

8. The invention according to claim 1 wherein the baffle is wider than the combuster.

9. The invention according to claim 1 wherein the baffle overlies most of the combuster.

10. The invention according to claim 1 wherein the baffle is inclined at an acute angle to the direction of movement of the flue gases.

11. The invention according to claim 9 wherein a forward portion of the combuster extends forwardly of the forwardmost extent of the baffle.

12. The invention according to claim 1 wherein the housing is formed of cast iron.

13. The invention according to claim 1 including a back plate parallel to and spaced from a rear wall of the housing.

14. A wood stove including an afterburner comprising a housing, means at the bottom of the housing for defining an inlet into the housing for flue gases from the wood stove, means at the top of the housing for defining an outlet from the housing for flue gases escaping to a flue, the outlet and the inlet being arranged adjacent the rear of the housing and in substantially overlying relationship, the housing having a forward section projecting forward in front of the inlet and outlet, a support member for a catalytic combuster, a manually operable handle extending from the exterior of the housing to the support for moving the support from a position in which the combuster overlies the inlet so that flue gases pass therethrough to a position in which the combuster lies in the forward section and is spaced from the inlet so as to allow the flue gases to pass from the inlet to the outlet without passing through the combuster, and baffle means mounted on the support means and movable therewith and arranged such that in the first position the baffle means diverts flue gases from the inlet into the forward section and in the second position the flue gases pass from the inlet to the outlet without engaging the baffle means.

* * * * *